US011470423B2

(12) United States Patent
Liao et al.

(10) Patent No.: US 11,470,423 B2
(45) Date of Patent: Oct. 11, 2022

(54) SPEAKER ASSEMBLY AND SPEAKER

(71) Applicant: Anker Innovations Technology Co. Ltd., Changsha (CN)

(72) Inventors: Yun Liao, Shenzhen (CN); Bo Dong, Shenzhen (CN)

(73) Assignee: Anker Innovations Technology Co., Ltd., Changsha (CN)

( * ) Notice: Subject to any disclaimer, the term of this patent is extended or adjusted under 35 U.S.C. 154(b) by 0 days.

(21) Appl. No.: 17/339,466

(22) Filed: Jun. 4, 2021

(65) Prior Publication Data

US 2021/0368275 A1 Nov. 25, 2021

Related U.S. Application Data

(63) Continuation-in-part of application No. PCT/CN2019/082278, filed on Apr. 11, 2019.

(30) Foreign Application Priority Data

Dec. 29, 2018 (CN) ..... 2018116457903

(51) Int. Cl.
*H04R 9/04* (2006.01)
*H04R 7/16* (2006.01)

(52) U.S. Cl.
CPC ..... *H04R 9/04* (2013.01); *H04R 7/16* (2013.01)

(58) Field of Classification Search
CPC ..... H04R 1/2873; H04R 1/1016; H04R 7/16; H04R 9/04; H04R 11/00; H04R 13/00
See application file for complete search history.

(56) References Cited

U.S. PATENT DOCUMENTS

2015/0373435 A1 12/2015 Chu et al.
2016/0192087 A1* 6/2016 van Halteren ..... H04R 11/04 381/170

FOREIGN PATENT DOCUMENTS

CN 202979246 U 6/2013
CN 204518007 U 7/2015
CN 206251310 U 6/2017
WO WO-2018042615 A1 * 3/2018 ..... H04R 1/06

OTHER PUBLICATIONS

Sep. 27, 2019 (WO) International Search Report—App. PCT/CN2019/082278.

* cited by examiner

*Primary Examiner* — Sunita Joshi
(74) *Attorney, Agent, or Firm* — Banner & Witcoff, Ltd.

(57) ABSTRACT

This application relates to the technical field of speakers and discloses a speaker assembly. The sound-raising assembly includes a first housing, the first housing forms a cavity. The sound assembly includes a cavity, a diaphragm and an armature member, a perimeter of the diaphragm is connected to an inner wall of the cavity, and a side of the diaphragm is provided with a voice coil, the voice coil for driving the vibration of the diaphragm. The armature member is set relative to the cavity and is located on the side of the diaphragm where the voice coil is set. The present application could improve the sound quality of the speaker.

17 Claims, 9 Drawing Sheets

SPEAKER ASSEMBLY AND SPEAKER

CROSS-REFERENCE TO RELATED APPLICATIONS

This Application is a continuation-in-part of Application PCT/CN2019/082278 filed on Apr. 11, 2019. Application PCT/CN2019/082278 claims priority from Application 2018116457903 filed on Dec. 29, 2018 in China. The entire disclosures of the prior applications are incorporated herein.

BACKGROUND OF INVENTION

Technology Field

This application relates to the technical field of speakers, and in particular to a speaker assembly and a speaker.

Technique of the Prior Art

Dynamic is a kind of speaker transducer. A driving mode of dynamic headphones is driven by a voice coil in a permanent magnetic field to drive the vibration of a diaphragm connected to the voice coil, so as to output sound. The voice coil inside an armature headphones is wound on a balanced armature located in the center of a permanent magnetic field, the balanced armature drives the diaphragm under the action of magnetic force to produce sound.

At present, in order to combine the respective advantages of dynamic headphones and armature headphones, coil-iron headphones combining dynamic and armature are provided. However, current coil-iron headphones usually have a separating armature unit and dynamic unit, the separation leads to a large sound wave phase difference, and reduce the sound quality of the headphones.

SUMMARY OF INVENTION

The present application provides a speaker assembly and a speaker to solve the above problems and to improve sound quality of the speaker.

In order to solve the above technical problems, the application provides a speaker assembly comprising: a first housing, an inner side wall of the first housing constitutes a first cavity; a diaphragm disposed in the first cavity, a circumference of the diaphragm is connected to the inner wall of the first housing; a voice coil disposed on one side of the diaphragm; and an armature member disposed in the first cavity, the armature member is located on a same side of the diaphragm as the voice coil.

In an embodiment of the application, a direction from the diaphragm to the armature member is a sound out direction of the speaker assembly.

In an embodiment of the present application, the speaker assembly further comprises a magnet and a second housing embedded in the first cavity, an inner side wall of the second housing forming a holding cavity. wherein the magnet, the holding cavity, and the voice coil are located on a same side of the diaphragm and are fixed in the first cavity. the second housing is provided with an opening connected to the holding cavity, the opening is oriented in the same direction as the sound out direction, at least part of the armature member is housed in the holding cavity through the opening.

In an embodiment of the present application, the magnet is a annular magnet and the holding cavity is located in a center of the annular magnet. A voice coil cavity is disposed between the inner wall of the first housing and an outer wall of the second housing, the voice coil is a ring around the holding cavity, and at least an end of the voice coil is embedded in the voice coil cavity. the voice coil cavity is formed by an inner wall of the annular magnet and an outer wall of the second housing, or formed by an outer wall of the annular magnet and the inner wall of the first housing.

In an embodiment of the present application, the annular magnet includes an outer annular magnet and an inner annular magnet. An inner wall of the inner annular magnet abuts against the outer wall of the second housing, an outer wall of the outer annular magnet abuts against the inner wall of the first housing. The voice coil cavity is formed by an inner wall of the outer annular magnet and an outer wall of the inner annular magnet.

In an embodiment of the present application, the second housing includes an extension, the extension is provided with a first through hole and the first through hole is connected to the voice coil cavity to form a first sound outlet channel.

In an embodiment of the present application, the second housing is provided with a second through hole, the second through hole communicates with the holding cavity to form a second sound outlet hole.

In an embodiment of the present application, at least part of the second housing is formed by magnetic conductor.

In an embodiment of the present application, the diaphragm comprises a recessed first membrane flap, and the holding cavity is at least partially housed in the first membrane flap.

In an embodiment of the present application, a first part, a second part axially connected to the first part, and a connector connecting the first part and the second part. A diameter of the first part is greater than a diameter of the second part. A perimeter of the diaphragm is attached to the first portion or the connector. The armature member is provided in the second part. The connector is provided with a third sound outlet hole.

In prior art, the side of the diaphragm away from the voice coil is usually designed with a protective structure such as a front cover, so it is not possible to set the armature member on the side of the diaphragm away from the voice coil, resulting in the distance between the armature member and the diaphragm cannot be further reduced. Since the distance between the diaphragm and the armature member is usually less than a minimum wavelength of audio, the greater the distance between the armature member and the diaphragm, the greater the phase difference between the output sound waves. Excessive phase differences can lead to audio separation between the sound output by the armature member and the diaphragm, reducing the sound quality of the speaker.

To overcome this problem, the application sets the voice coil and the armature member on a same side of the diaphragm, further reducing the distance between the armature member and the diaphragm. This setting can reduce the phase difference between the sound waves output by the armature member and the diaphragm, improve the phenomenon of audio separation, and thus improve the sound quality of the speaker.

BRIEF DESCRIPTION OF DRAWINGS

In order to more clearly illustrate the technical solutions in the embodiments of the present application, the following will be briefly described in the description of the embodiments required to use the attached drawings, it is obvious that the following description of the attached drawings are only some of the embodiments of the present application, for the ordinary skilled person in the field, without creative work, but also according to these drawings, other drawings can be obtained.

DETAILED DESCRIPTION OF EMBODIMENTS

In order to make the object, technical solutions and advantages of the present application more apparent, the following exemplary embodiments according to the present application will be described in detail with reference to the accompanying drawings. It will be understood that the specific embodiments described herein are for the purpose of explaining the present application only and are not a limitation of the present application. It should also be noted that for ease of description, the accompanying drawings show only some, but not all, of the structures relevant to this application. Based on the embodiments of this application described in this application, all other embodiments obtained by a person skilled in the art without creative labor shall fall within the scope of protection of this application.

The terms "first", "second", etc. in this application are used to distinguish between different objects and are not used to describe a particular order. In addition, the terms "includes" and "has", and any variations thereof, are intended to cover non-exclusive inclusion. For example, a process, method, system, product, or apparatus that includes a series of steps or units is not limited to the listed steps or units, but optionally also includes steps or units that are not listed, or optionally also includes other steps or units that are inherent to the process, method, product, or apparatus.

References herein to "embodiments" mean that particular features, structures or characteristics described in connection with an embodiment may be included in at least one embodiment of the present application. The occurrence of the phrase at various points in the specification does not necessarily mean the same embodiment, nor is it a separate or alternative embodiment that is mutually exclusive with other embodiments. It is understood, both explicitly and implicitly, by those skilled in the art that the embodiments described herein may be combined with other embodiments.

Figure 1:
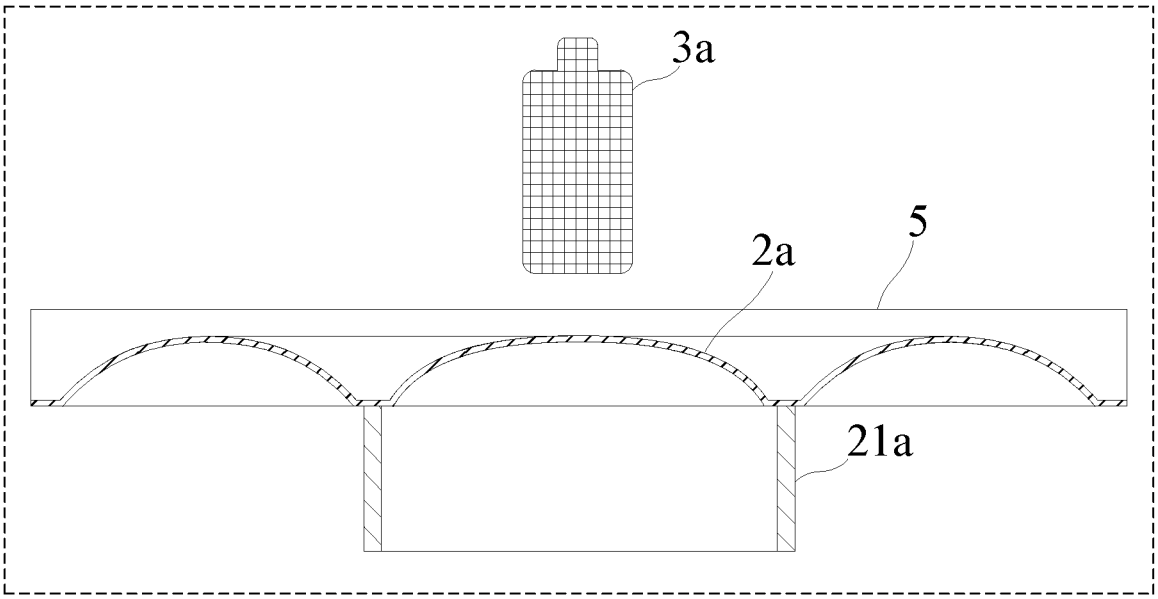
FIG. 1 is a cross-sectional view of a structure of a speaker assembly in the prior art.

Referring to FIG. 1, FIG. 1 is a cross-sectional view of the structure of the speaker assembly in the prior art.

The speaker assembly includes a diaphragm 2*a* and an armature member 3*a*, the voice coil 21*a* is located on one side of the diaphragm 2*a*, the armature member 3*a* is located on the other side of the diaphragm 2*a*, that is, the voice coil 21*a* and the armature member 3*a* are located on both sides of the diaphragm 2*a*. A side of the diaphragm 2*a* back away from the voice coil 21 is provided with a front cover 5, the front cover 5 is located between the diaphragm 2*a* and armature member 3*a*. Therefore, it is not possible to set the armature member on the side of the diaphragm away from the voice coil, so the distance between the armature member and the diaphragm cannot be further reduced. Since the distance between the diaphragm 2*a* and armature member 3*a* is usually less than the minimum wavelength of audio, the greater the distance between the armature member 3*a* and the diaphragm 2*a*, the greater the phase difference between the output sound waves. Excessive phase differences can lead to audio separation between the sound output by the armature member 3*a* and the diaphragm 2*a*, reducing the sound quality of the speaker.

In order to overcome this problem, an embodiment of the present application provides a first housing, an inner side wall of the first housing constitutes a first cavity; a diaphragm disposed in the first cavity, a circumference of the diaphragm is connected to the inner wall of the first housing; a voice coil disposed on one side of the diaphragm; and an armature member disposed in the first cavity, the armature member is located on a same side of the diaphragm as the voice coil.

Figure 2:
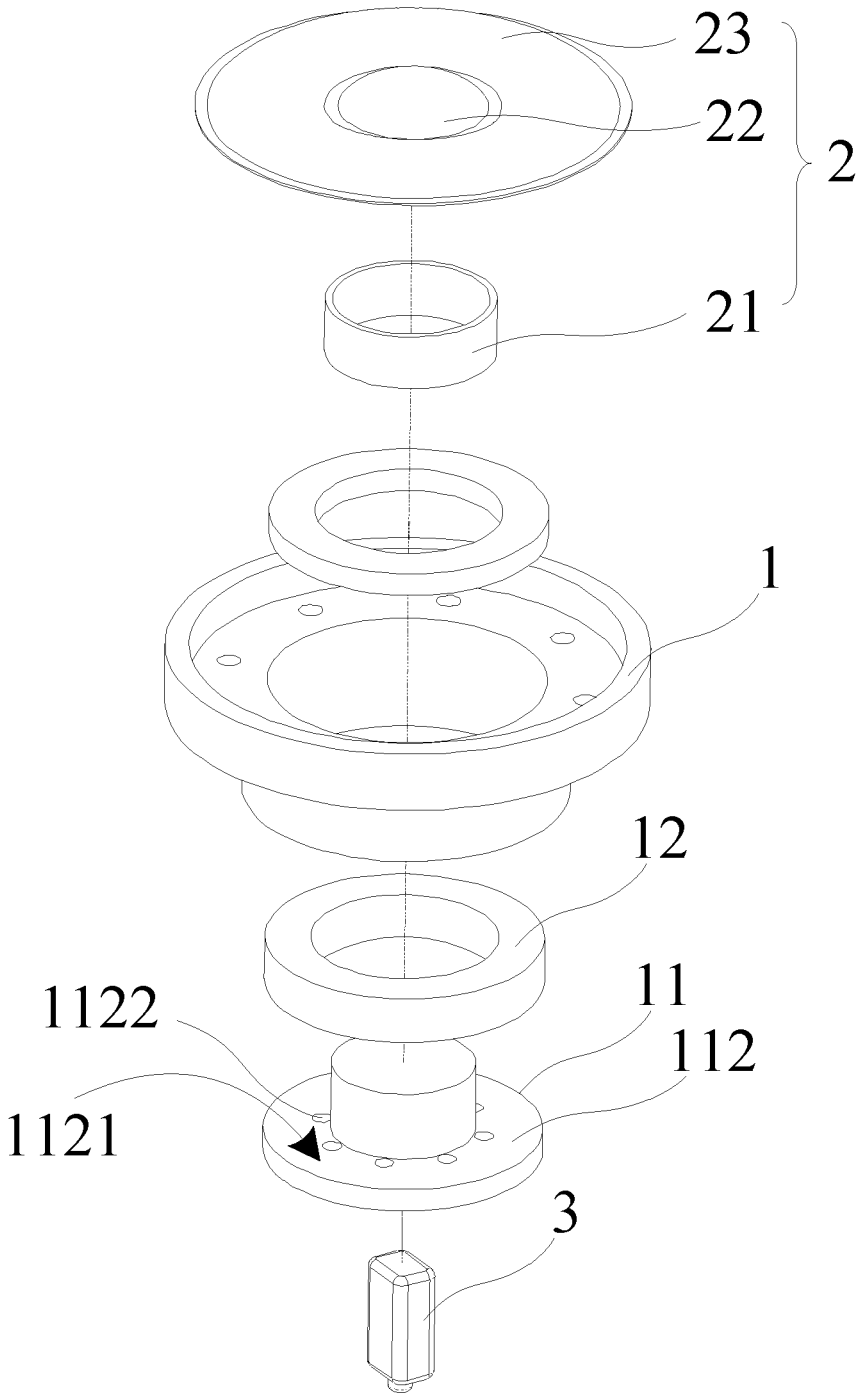
FIG. 2 is a schematic diagram of the exploded structure of a speaker assembly of a first embodiment of the present application.
Figure 3:
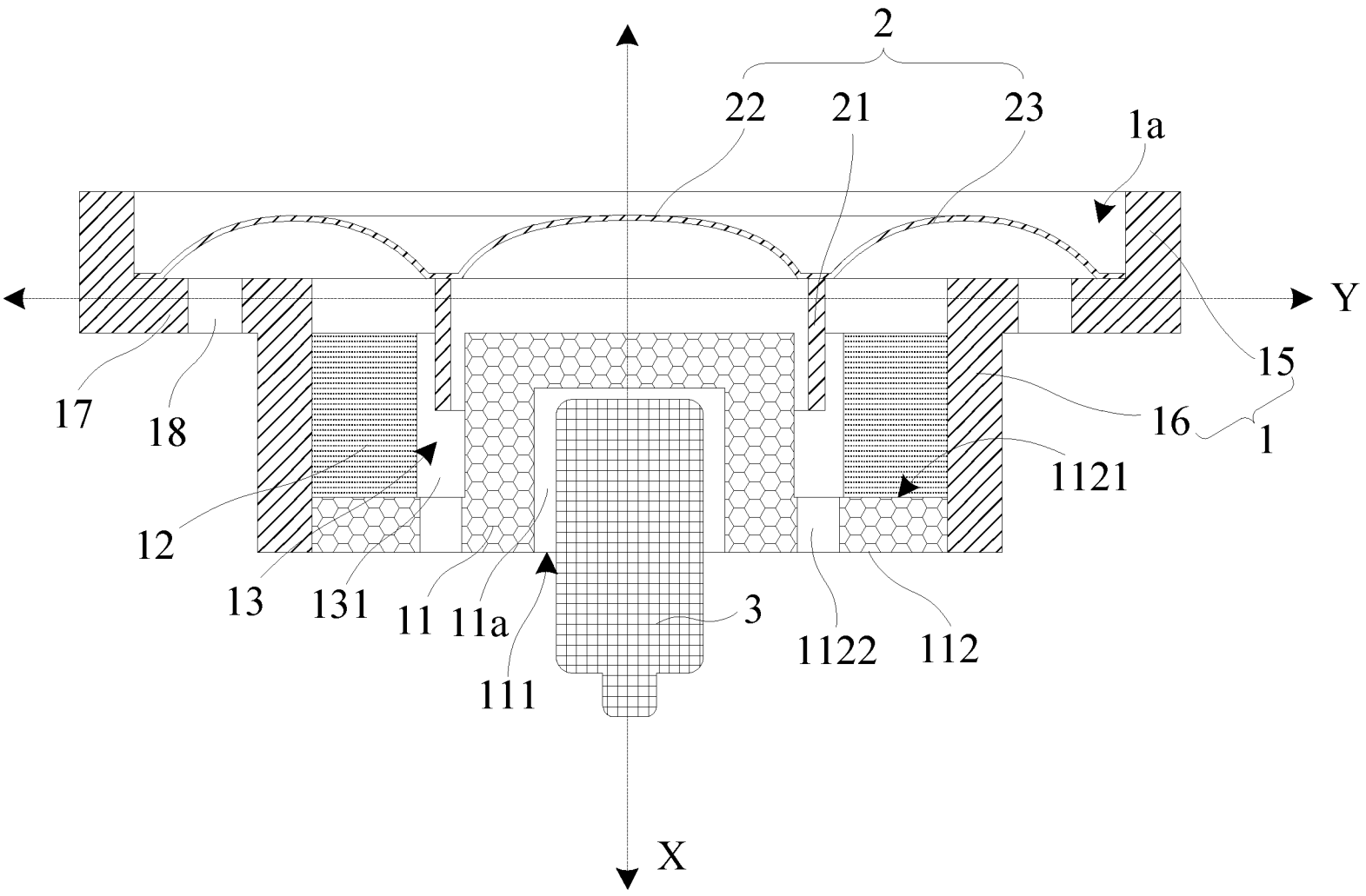
FIG. 3 is a cross-sectional view of a structure of the speaker assembly shown in FIG. 2.

Referring to FIG. 2 and FIG. 3, FIG. 2 is an exploded diagram of the speaker assembly in the first embodiment of the present application, and FIG. 3 is a cross-sectional diagram of the speaker assembly shown in FIG. 2.

As shown in FIGS. 2 and 3, in one embodiment, the speaker assembly includes a first housing 1, an inner wall of the first housing 1 forms a first cavity 1*a*. Further, the first cavity 1*a* runs through the first housing 1. The diaphragm 2 is provided in the first cavity 1*a*, and a circumference of the diaphragm 2 is connected to the inner wall of the first housing 1. The diaphragm 2 is set on the side where the voice coil 21 is set. The speaker assembly also includes a armature member 3, which is set on the same side of the diaphragm as the voice coil 21. The speaker assembly also includes a magnet (such as the annular magnet 12 described below), the magnet is provided on the same side of the diaphragm as said voice coil 21.

The diaphragm 2 could adopt the structure of the diaphragm in prior art, in which the voice coil 21 is placed in a magnetic field, by passing AC current to the voice coil 21, thus driving the movement of the voice coil 21 under the interaction of the magnetic field and the voice coil 21, and drives the diaphragm 2 to vibrate and produce sound.

The armature member 3 can adopt a armature unit of current armature headphones, and its sound output principle can also adopt the sound output principle of the armature unit of current armature headphones. The diaphragm 2 and armature member 3 in this embodiment correspond to the traditional dynamic unit and armature unit, that is, the speaker assembly elaborated in this embodiment is a coil-iron speaker assembly. The diaphragm 2 and the armature member 3 have different audio performance capabilities in different frequency bands. Diaphragm 2 has good audio performance in the middle and low frequency bands, i.e., the audio output from diaphragm 2 in the middle and low frequency bands has good sound quality. Armature member 3 in the high frequency band has good audio performance, that is, the armature member 3 output of the high frequency band of audio with good sound quality. Diaphragm 2 and armature member 3 complement each other, so that the audio output from the speaker assembly has a good sound quality.

As can be seen above, the armature member 3 and the voice coil 21 of the diaphragm 2 are set on the same side, to reduce the distance between the armature member 3 and the diaphragm 2, thereby to reduce the phase difference between the output sound waves of the armature member 3 and the diaphragm 2. The sound separation of the armature member 3 and the diaphragm 2 is reduced, and the sound quality of the speaker is improved.

In order to set the armature member 3 on the same side as the voice coil 21 of the diaphragm 2, this application adapts an acoustic curve of the speaker assembly, so that the acoustic curve of the speaker assembly of this application differs from that of the prior art. This difference prevents the prior art from directly setting the armature member 3 on the same side as the voice coil 21 of the diaphragm 2 as in the present application.

As shown in FIGS. 2 and 3, in one embodiment, a direction from the diaphragm 3 to the armature member 2 is a sound out direction of the speaker assembly. In other words, a side of the diaphragm 2 setting the voice coil 21 is the sound output direction. In the prior art, a side that not set the voice coil faces the sound output direction of the diaphragm, and the side with the voice coil is used to drive the vibration of the diaphragm. In this embodiment, the diaphragm 2 is inverted so that the side (or back) of the diaphragm 2 with the voice coil 21 is set facing the direction of the sound output from the speaker assembly. The armature member 3 and the voice coil 21 are set on the same side, thereby the armature member 3 and the diaphragm 2 has a same sound output direction, and the diaphragm 2 will not block the sound of the armature member 3.

In coil-iron headphones of the prior art, the side of the diaphragm back to the voice coil is the front side, and facing the direction of the sound output from the speaker assembly. Protective structures such as front cap are set in the side of the diaphragm back to the voice coil, so the armature member has to be set away from the diaphragm, and lead to a great phase difference between the sound waves output by the diaphragm and the armature member. If referring to the coaxial unit structure of large size speakers, opening a hole on the center of the dynamic diaphragm and putting the armature unit in the hole, a sound output ability of the armature unit could be obtained. However, the hole in the center of the dynamic diaphragm would result interference of the sound waves produced by both sides of the dynamic diaphragm, reducing the sound performance of the dynamic diaphragm. Further, it's hard to open a hole in the center of the dynamic diaphragm in small size speakers.

In this application, a side (or back) of the diaphragm 2 setting the voice coil 21 faces the sound direction of the speaker assembly, eliminating the constraints of the front cover and other protective structures in the prior art, further reducing the distance between the armature member 3 and the diaphragm 2, reducing the phase difference between the sound waves output by the armature member 3 and the diaphragm 2, and improving the sound quality of the speaker assembly.

Moreover, the diaphragm 2 does not need to be opened, which can keep the surface of the diaphragm 2 completing, thus avoid the sealing problem and acoustic interference caused by the opening of the diaphragm 2. The distance between the armature member 3 and the diaphragm 2 is reduced, so that the sound path from the armature member 3 and diaphragm 2 to the human ear eardrum is highly similar in structure (i.e., the sound wave transmission process is highly similar in structure), thus the mutual interference between the armature member 3 and the diaphragm 2 caused by the different structure of the sound path is effectively avoided, which is conducive to obtaining a better effect of the combination of the armature member 3 and diaphragm 2, and improve the overall sound quality of the speaker assembly.

As shown in FIGS. 2 and 3, in one embodiment, the speaker assembly includes a magnet and a second housing 11 embedded in the first cavity 1*a*, an inner side wall of the second housing 11 forming a holding cavity 11*a*. Both the magnet and the holding cavity 11*a* are located on the side of the diaphragm 2 where the voice coil 21 is set, and are fixed in the cavity 1*a*. The magnet is set on the side where the voice coil 21 is set. The second housing 11 is provided with an opening 111 connected to the holding cavity 11*a*.

The opening 111 is oriented in the same direction as the sound output direction of the speaker assembly. The armature member 3 is at least partially housed in the holding cavity 11*a*. That is, the at least part of the armature member 3 is housed in the holding cavity 11*a* through the opening 111, so that the direction of sound output of the armature member 3 is the same as the direction of sound output of the speaker assembly.

The magnet is used to generate a magnetic field, and the voice coil 21 of the diaphragm 2 is placed in the magnetic field generated by the magnet. Through the interaction between the magnetic field and the voice coil 21, the voice coil 21 is driven to move, which in turn drives the diaphragm 2 to vibrate and produce sound. In the embodiment, the magnetic field generated by the magnet is a permanent magnetic field, and the voice coil 21 is fed with alternating current, allowing the voice coil 21 to move back and forth, which in turn drives the diaphragm 2 to vibrate. Of course, the voice coil 21 can also be energized with direct current, and the magnetic field generated by the magnet is variable in direction, driving the voice coil 21 back and forth through the magnetic field that changes direction, no limitation here.

Further, the magnet may be an annular magnet 12. The outer side of the annular magnet 12 is provided adjacent to the inner wall of the first housing 1. The second housing 11 is located in a center of the annular magnet 12. Correspondingly, the voice coil 21 may also be annular in shape so that an area of the action surface of the voice coil 21 and the magnet is maximized to increase the efficiency of the magnetically driven movement of the voice coil 21.

Figure 6:
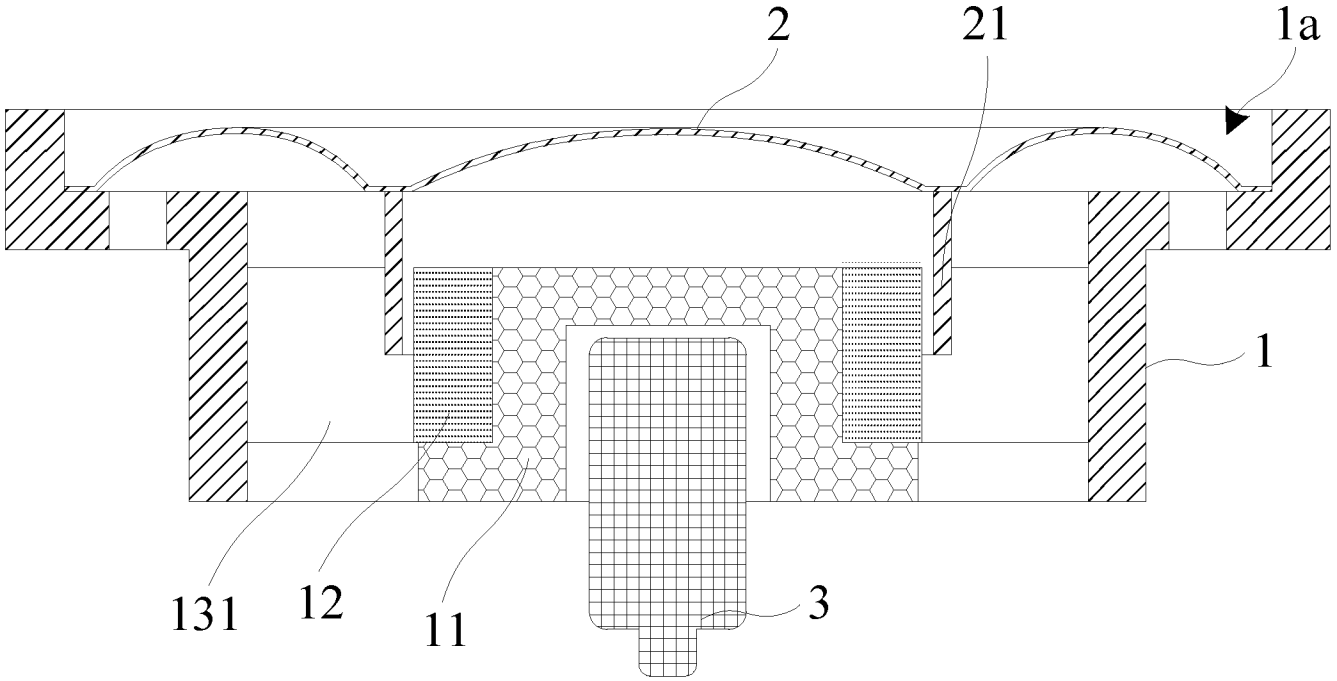
FIG. 6 is a cross-sectional view of a structure of the speaker assembly of a third embodiment of the present application.
Figure 7:
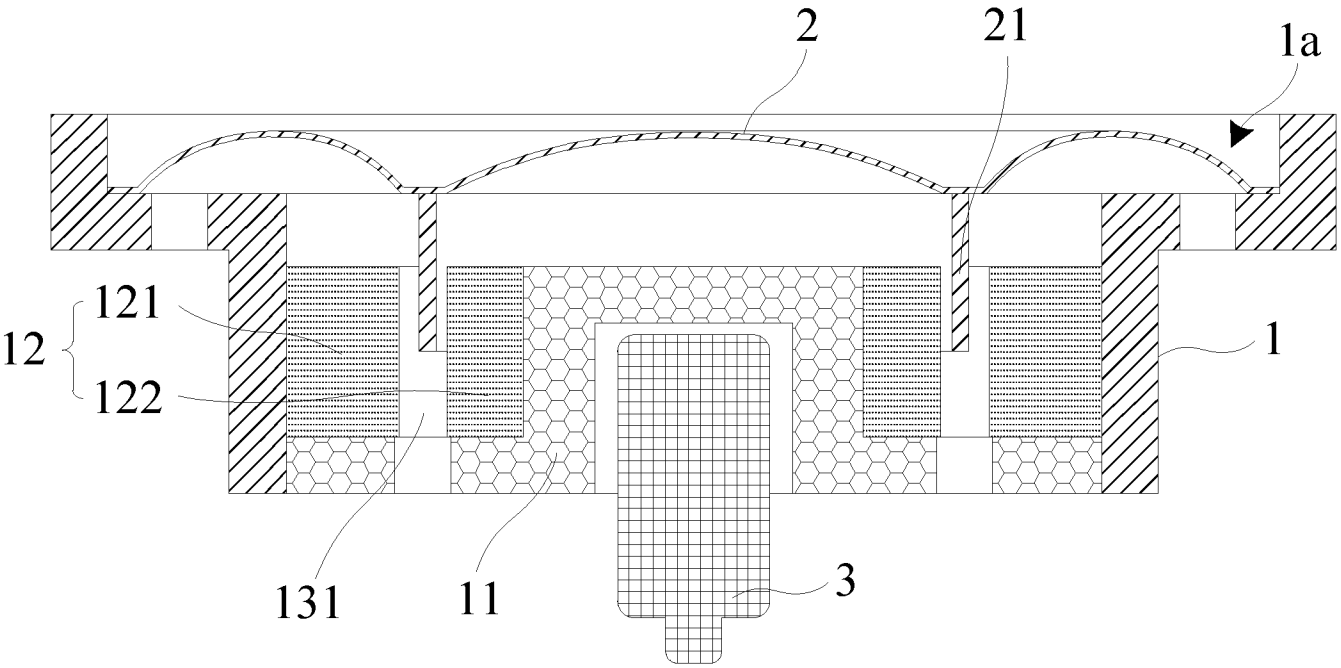
FIG. 7 is a cross-sectional view of a structure of the speaker assembly of a fourth embodiment of the present application.

In an embodiment, a voice coil cavity 131 is provided between the inner wall of the first housing 1 and the outer wall of the second housing 11, the voice coil cavity 131 being annular around said holding cavity, said voice coil 21 being at least end-embedded in said voice coil cavity 131. The voice coil cavity 131 is located between the annular magnet 12 and the first housing 1 (as shown in FIG. 3), or between the annular magnet 12 and the inner wall of the second housing 11 (as shown in FIG. 6), or in the annular magnet 12 (as shown in FIG. 7). It can be shown that at least one side wall of the voice coil cavity 131 is near the annular magnet 12.

Since the side walls of at least one side of the voice coil cavity 131 are annular magnets 12, it is possible to ensure a relatively strong interaction between the voice coil 21 and the annular magnets 12. Meanwhile, the voice coil cavity 131 is used to provide space for the movement of voice coil 21, which moves back and forth axially in the voice coil cavity 131, thus driving the diaphragm 2 to vibrate and produce sound.

In one embodiment, the outer wall of the annular magnet 12 abuts the inner wall of the first housing 1, and the space between the inner wall of the annular magnet 12 and the corresponding outer wall of the second housing 11 forms the voice coil cavity 131, i.e., the magnet of the speaker assembly is an external magnetic structure. The speaker assembly illustrated in FIG. 3 is a rotationally symmetric structure, the direction defined by its rotationally symmetric axis is the axial X of the speaker assembly, and the direction perpendicular to its rotationally symmetric axis is the radial Y of the speaker assembly. The space between the side walls extending along the axial direction X of the speaker assembly on the second housing 11 and the inner wall of the annular magnet 12 forms the voice coil cavity 131.

Further, an edge of the second housing 11 extends radially Y outwardly to form an extension 112, and the extension 112 abuts the inner wall of the first housing 1. The magnet (i.e., the annular magnet 12) abuts against the inner surface 1121 of the extension 112 on the side facing the sound exit direction of the sound raising assembly. The extension 112 is provided with a first through hole 1122. The first through-hole 1122 connects to the voice coil cavity 131 to form the first outlet channel 13. That is, the voice coil cavity 131 is not only used to provide space for the movement of the voice coil 21, but also serves as an outlet channel involved in transmitting the sound waves generated by the vibration of the diaphragm 2.

As shown in FIG. 3, in one embodiment, the voice coil 21 in the voice coil cavity 131 does not extend partially to the first through hole 1122 in the extension 112. The voice coil cavity 131 is annular and around the holding cavity 11*a*, the extension 112 is provided with a plurality of first through-holes 1122 which are spaced circumferentially around the extension 112 as the end of the first sound outlet channel 13.

In other embodiments, the first through-holes 1122 may also be annular corresponding to the voice coil cavity 131, and forms a complete pathway structure with the voice coil cavity 131 to form the acoustic pathway of the diaphragm 2.

For the coil-iron headphones in the prior art, it is difficult to achieve effective magnetic shielding because the components inside the armature member 3 are susceptible to external magnetic interference. Thereby, at least a portion of the second housing 11 near the holding cavity 11*a* of this embodiment comprises a magnetic conductor, and a magnetic conductivity of the holding cavity is greater than a magnetic conductivity of air to shield the magnetic field of the annular magnet 12 from interference with the armature member 3.

As mentioned earlier, another reason that constrains the prior art from setting the armature member 3 on the same side as the voice coil 21 is that it is more difficult to achieve effective magnetic shielding inside the headphones of the prior art from setting the armature member 3. Directly set the armature member 3 and the voice coil 21 on the same side, will make the armature member 3 too close to the voice coil 21 and annular magnet 12, the external magnetic field will inevitably cause serious interference to the armature member 3. In this embodiment, a magnetic shield is formed by the second housing 11 composed of a magnetic conductor, which is provided at the periphery of the armature member 3 and can effectively shield the magnetic field of the voice coil 21 and the annular magnet 12 from interfering with the armature member 3.

Further, to improve the magnetic shielding effect of the second housing 11, the second housing 11 is composed entirely of magnetic conductors. The magnetic conductivity of the second housing 11 is greater than the air in the environment in which the holding cavity 11*a* is located. The magnetic field generated by the annular magnet 12 is located in the atmosphere, and the magnetic induction lines of the annular magnet 12 all pass through the sidewall of the second housing 11 at the intersection of the atmosphere and the second housing 11, while there are fewer magnetic induction lines inside the holding cavity 11*a*, thus achieving a good magnetic shielding effect.

The magnetic conductivity of the second housing 11 may be much greater than the magnetic conductivity of the air in the environment in which the holding cavity 11*a* is located, to further improve the magnetic shielding effect of the second housing 11. Thereby the armature member 3 and diaphragm 2 are able to adjacent to each other, the influence of the magnetic field in the prior art which set away the armature member and the dynamic is eliminated, the problem of the large phase difference between sound waves outputting by the armature member and the dynamic is thus solved.

The magnetic conductor can be T-iron, etc., which is pure iron in texture and is not limited here.

Figure 5:
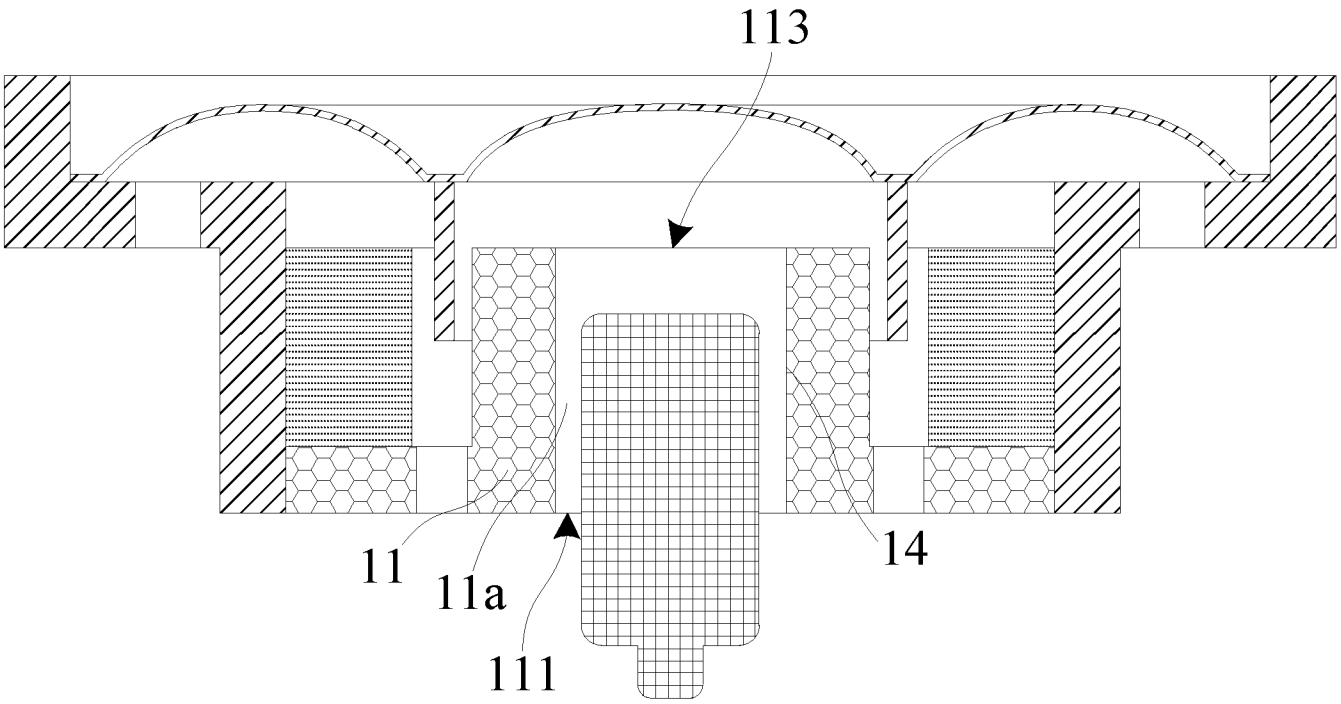
FIG. 5 is a cross-sectional view of a structure of the speaker assembly of a second embodiment of the present application.

Please refer to FIG. 5. In an embodiment, a second through hole 113 is opened in the part of the second housing 11 relative to the opening 111. That is, a second through hole 113 is opened at the bottom of the second housing 11. The second through hole 113 communicates with the space in the holding cavity 11*a* and the opening 111 to form the second outlet hole 14. This embodiment improves the sound quality of the speaker assembly by adding a second outlet hole 14 to increase the number of sound outlets on the speaker assembly.

Figure 4:
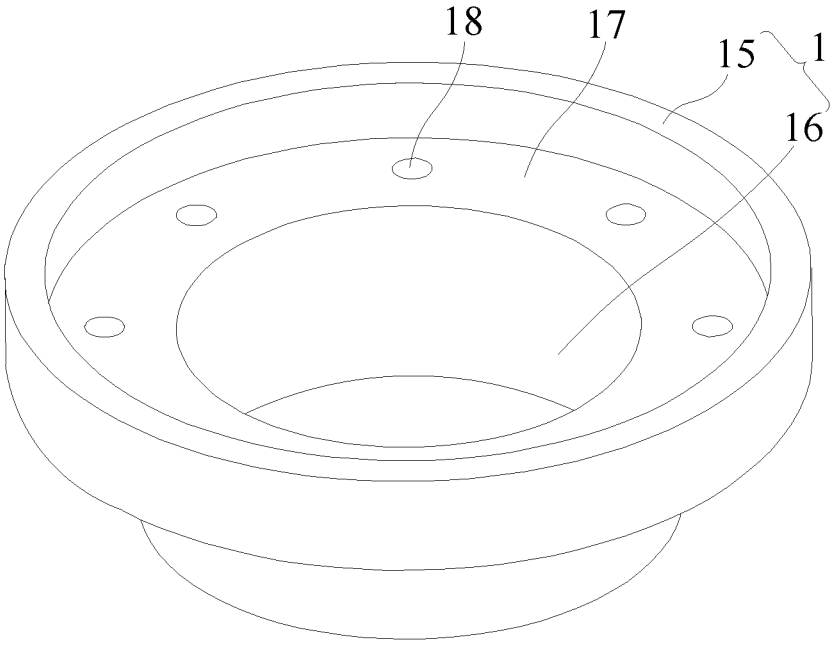
FIG. 4 is a schematic diagram of the structure of a first housing of the speaker assembly shown in FIG. 2.

Please refer to FIG. 3 and FIG. 4. In an embodiment, the first housing 1 includes a first part 15 and a second part 16 that are axially connected. The diameter of the first part 15 is larger than the diameter of the second part 16, and the first part 15 and the second part 16 are connected by a connector 17. The perimeter of the diaphragm 2 is attached to the inner wall of the first part 15 or the inner wall of the connector 17. FIG. 3 shows the diaphragm 2 with its circumferential edge attached to the inner wall of the first part 15. The armature member 3 is provided in the second part 16.

In the speaker assembly illustrated in FIGS. 3 and 4, the perimeter of the diaphragm 2 is attached to the inner wall of the first part 15. The connector 17 is provided with a third sound outlet hole 18. The third outlet hole 18 is provided corresponding to the part of the circumference of the diaphragm 2, in order to further increase the number of outlets on the speaker assembly and thus improve the sound quality of the speaker assembly.

It should be noted that at least one of the first outlet channel 13, the second outlet hole 14, and the third outlet hole 18 serves as the outlet hole of the speaker assembly. It is possible that the first outlet channel 13, the second outlet hole 14, and the third outlet hole 18 are all used as the outlet holes of the speaker assembly. Or any two of the first outlet channel 13, the second outlet hole 14, and the third outlet hole 18 are combined as the outlet holes of the speaker assembly. Or any one of the first outlet channel 13, the second outlet hole 14, and the third outlet hole 18 is used as the outlet holes of the speaker assembly.

It should also be noted that the speaker assembly described in this embodiment is mainly used in small size speakers, and can improve the combination of the armature unit and the dynamic unit in small size speakers. It can be used in speakers such as wired headphones or wireless headphones. It will be appreciated that the speaker assembly set forth in this embodiment may also be applied in the field of medical devices, such as hearing aids, no further limitation herein.

In summary, the voice coil of the diaphragm is set on the same side as the armature member, which allows the armature member to be set close to the sound outlet position of the diaphragm, to reduce the phase difference between output sound waves of the armature member and the diaphragm, and then reduce sound separation to improve the sound quality of the speaker.

Referring to FIG. 6, FIG. 6 is a cross-sectional view of the structure of the speaker assembly in the third embodiment of the present application.

In one embodiment, the speaker assembly includes a first housing 1, an inner wall of the first housing 1 forms a first cavity 1*a*. The diaphragm 2 is provided in the first cavity 1*a*, and a circumference of the diaphragm 2 is connected to the inner wall of the first housing 1. The diaphragm 2 is set on the side where the voice coil 21 is set. The speaker assembly also includes a armature member 3, which is set on the same side of the diaphragm as the voice coil 2.

The difference between this embodiment and the above embodiment is that the inner wall of the annular magnet 12 abuts the outer wall of the second housing 11, and the space between the outer wall of the annular magnet 12 and the inner wall of the first housing 1 forms the voice coil cavity 131, i.e., the magnet of the sound raising assembly is an internal magnetic structure.

Referring to FIG. 7, FIG. 7 is a cross-sectional view of the structure of the speaker assembly in the fourth embodiment of the present application.

In one embodiment, the speaker assembly includes a first housing 1, an inner wall of the first housing 1 forms a first cavity 1*a*. The diaphragm 2 is provided in the first cavity 1*a*, and a circumference of the diaphragm 2 is connected to the inner wall of the first housing 1. The diaphragm 2 is set on the side where the voice coil 21 is set. The speaker assembly also includes a armature member 3, which is set on the same side of the diaphragm as the voice coil 2.

This embodiment differs from the above embodiment in that the annular magnet 12 includes an outer annular magnet 121 and an inner annular magnet 122 provided in a nested configuration. The inner wall of the inner annular magnet 122 abuts against the outer wall of the second housing 11, and the outer wall of the outer annular magnet 121 abuts against the inner wall of the first housing 1. In this case, the space between the inner wall of the outer annular magnet 121 and the outer wall of the inner annular magnet 122 forms the voice coil cavity 131, i.e., the magnet of the speaker assembly is an internal and external magnet structure.

In this way, there are magnets on both sides corresponding to the part of the voice coil 21 located in the voice coil cavity 131. Compared with the internal or external magnet structure in the above-mentioned embodiments, the magnet with the internal and external magnet structure is more efficient in driving the voice coil 21, which can ensure that the efficiency of the voice coil 21 in driving the vibration of the diaphragm 2 is sufficient to meet the needs in practice.

Figure 8:
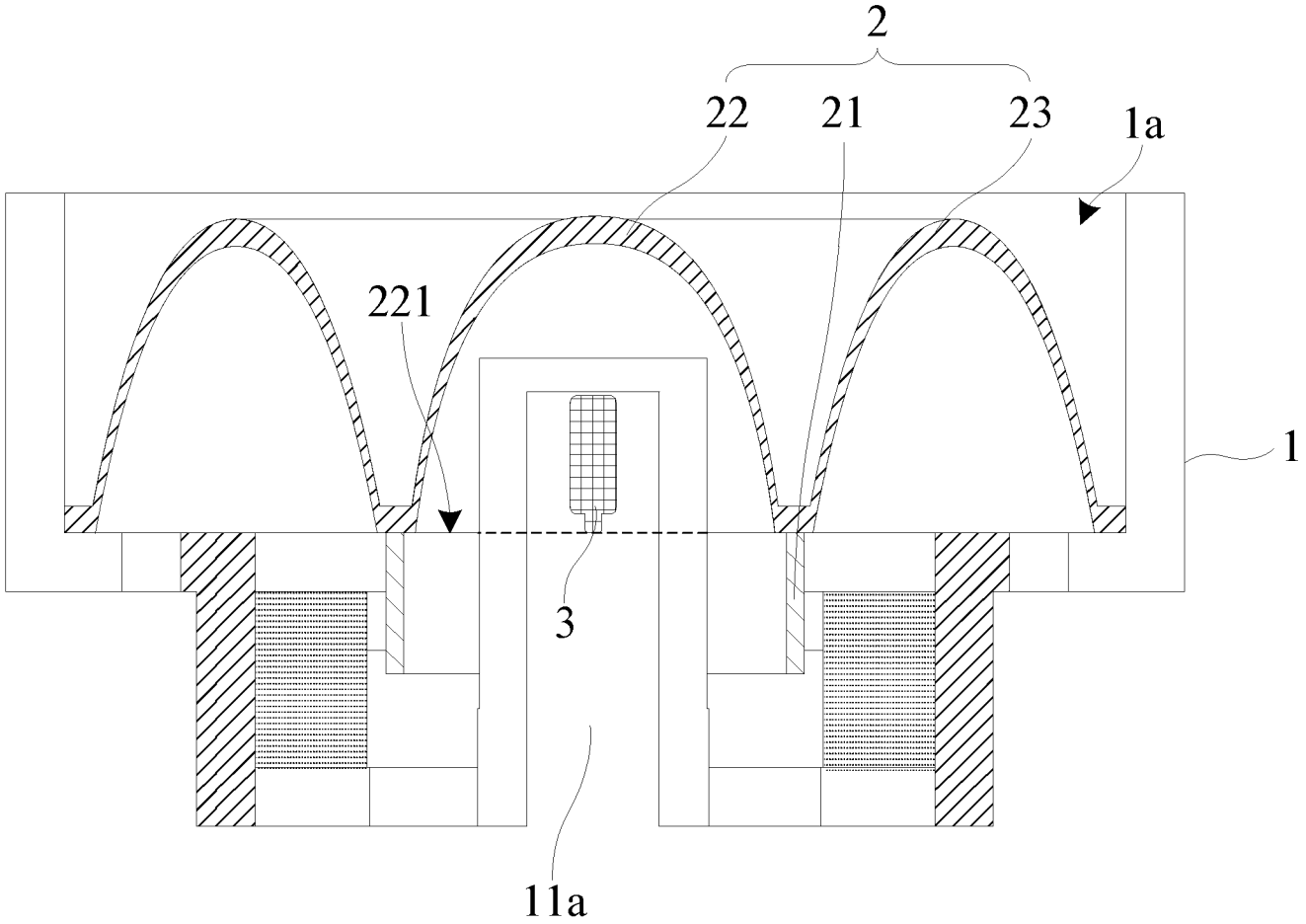
FIG. 8 is a cross-sectional view of a structure of the speaker assembly of a fifth embodiment of the present application.

Referring to FIG. 8, FIG. 8 is a cross-sectional view of the structure of the speaker assembly in the fifth embodiment of the present application.

In one embodiment, the speaker assembly includes a first housing 1, an inner wall of the first housing 1 forms a first cavity 1*a*. The diaphragm 2 is provided in the first cavity 1*a*, and a circumference of the diaphragm 2 is connected to the inner wall of the first housing 1. The diaphragm 2 is set on the side where the voice coil 21 is set. The speaker assembly also includes a armature member 3, which is set on the same side of the diaphragm as the voice coil 2.

Further, the diaphragm 2 includes a first membrane flap 22 and a second membrane flap 23, the second membrane flap 23 is in annular, the first membrane flap 22 is located in the center of the second membrane flap 23, and connected with the second membrane flap 23 to form the complete radiation body of the diaphragm 2. The voice coil 21 drives the first membrane flap 22 and the second membrane flap 23 vibration to produce sound. The first membrane flap 22 corresponds to the holding cavity 11*a*, that is, the holding cavity 11*a* corresponds to the central of the diaphragm 2, so that the armature member 3 inside the holding cavity 11*a* corresponds to the central of the diaphragm 2, which could ensure the sound path of the armature member 3 and the diaphragm 2 is highly similar.

The present embodiment differs from the above embodiment in that the first membrane flap 22 has a larger curvature and curved surface area, and a side of the first membrane flap 22 adjacent to the holding cavity 11*a* is recessed, which has an edge 221. At least a portion of the holding cavity 11*a* is housed in the recessed first membrane flap 22, thereby allowing the armature member 3 to be located in the space encompassed by the first membrane flap 22. Specifically, an end of the armature member 3 away from the diaphragm 2 is flush with the edge 221 of the first diaphragm 22 to minimize the difference between the sound positions of the armature member 3 and the diaphragm 2, then reduce the phase difference of the sound waves output by the armature member 3 and the diaphragm 2.

Figure 9:
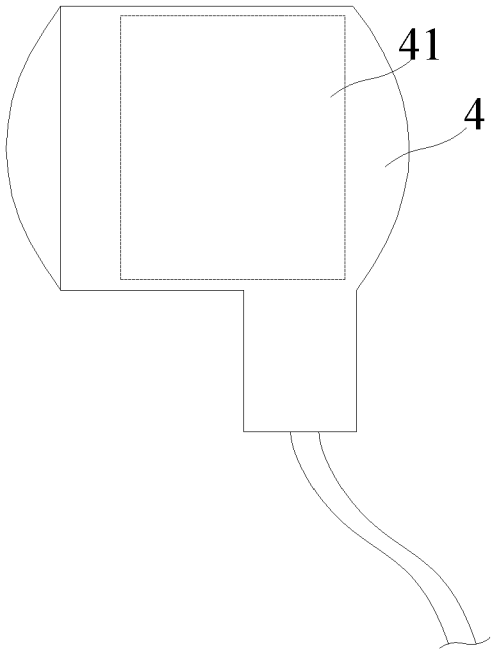
FIG. 9 is a schematic diagram of a structure of a headphone an embodiment of the present application.

Referring to FIG. 9, FIG. 9 is a schematic diagram of the structure of a headphone of the present application.

In an embodiment, the headphone 4 includes a speaker assembly 41. The speaker assembly 41 works to produce sound, thereby enabling the headphone 4 to output the corresponding audio information to the user. Headphone 4 can be wired or wireless headphones, in-ear or external headphones, or medical equipment in headphone form, such as hearing aids, no further limitation here. The specific structure and working principle of the speaker assembly 41 have been detailed in the above-mentioned embodiments, no repeat here.

The above is only an implementation of this application, and is not intended to limit the scope of this application. Any equivalent structure or equivalent process transformation using the contents of this application and the accompanying drawings, or any direct or indirect application in other related technical fields, is included in the scope of patent protection of this application.

What is claimed is:

1. A speaker assembly comprising:

a first housing, the first housing comprising an inner wall and the inner wall forming a first cavity;

a diaphragm located in the cavity, wherein a periphery of the diaphragm is connected to the inner wall of the first housing;

a voice coil attached to one side of the diaphragm;

an armature located in the first cavity, wherein the armature is on a same side of the diaphragm as the voice coil;

a magnet; and a second housing embedded in the first cavity, an inner wall of the second housing forming a second cavity, wherein:

the magnet, the second cavity, and the voice coil are located on a same side of the diaphragm and are fixed in the first cavity;

the second housing is provided with an opening connected to the second cavity;

the direction from the second cavity to the opening is a same direction of a sound generated from the speaker assembly; and at least part of the armature is housed in the second cavity through the opening.

2. The speaker assembly according to claim 1, wherein a direction from the diaphragm to the armature is a same direction of a sound generated from the speaker assembly.

3. The speaker assembly according to claim 1, wherein:

the magnet is an annular magnet, and the second cavity is located in a center of the annular magnet;

a voice coil cavity is located between the inner wall of the first housing and an outer wall of the second housing; and the voice coil is a ring around the second cavity, and at least an end of the voice coil is embedded in the voice coil cavity.

4. The speaker assembly according to claim 3, wherein the voice coil cavity is formed by:

an inner wall of the magnet and an outer wall of the second housing; or an outer wall of the magnet and the inner wall of the first housing.

5. The speaker assembly according to claim 3, wherein:

the annular magnet comprises an outer annular magnet and an inner annular magnet;

an inner wall of the inner annular magnet is connected to the outer wall of the second housing;

an outer wall of the outer annular magnet is connected to the inner wall of the first housing; and the voice coil cavity is formed by an inner wall of the outer annular magnet and an outer wall of the inner annular magnet.

6. The speaker assembly according to claim 3, wherein:

the second housing comprises an extension that comprises a first through hole, and the first through hole is connected to the voice coil cavity to form a first sound outlet channel.

7. The speaker assembly according to claim 1, wherein the second housing comprises a second opening, and the second opening is connected to the second cavity to form a second sound outlet channel.

8. The speaker assembly according to claim 1, wherein at least part of the second housing is formed by a magnetic conductor.

9. The speaker assembly according to claim 1, wherein the diaphragm comprises a recessed membrane, and the second cavity is at least partially housed in the recessed membrane.

10. The speaker assembly according to claim 1, wherein the first housing comprises:

a first part;

a second part axially connected to the first part; and a connector connecting the first part and the second part, wherein:

a diameter of the first part is greater than a diameter of the second part;

a periphery of the diaphragm is attached to the first part or the connector;

the armature is provided in the second part; and the connector comprises a third sound outlet channel.

11. A speaker assembly comprising:

a first housing, an inner wall of the first housing forming a first cavity;

a diaphragm located in the first housing;

a voice coil attached to the diaphragm; and an armature located in the first housing, wherein the armature is on a same side of the diaphragm as the voice coil;

a magnet; and a second housing located in the first cavity, an inner wall of the second housing forming a second cavity, wherein:

the magnet, the second cavity, and the voice coil are located on a same side of the diaphragm and are fixed in the first cavity;

the second housing is provided with an opening connected to the second cavity; and at least part of the armature is housed in the second cavity through the opening.

12. The speaker assembly according to claim 11, wherein a direction from the diaphragm to the armature is a same direction of a sound generated from the speaker assembly.

13. The speaker assembly according to claim 11, wherein the diaphragm comprises a recessed membrane, and the recessed membrane forms a cavity.

14. A speaker comprising:

a first housing, an inner wall of the first housing forming a first cavity;

a diaphragm located in the first cavity, wherein a periphery of the diaphragm is connected to the inner wall of the housing;

a voice coil attached to the diaphragm;

an armature located in the cavity, wherein the armature is on a same side of the diaphragm as the voice coil;

a magnet; and a second housing located in the first cavity, an inner wall of the second housing forming a second cavity, wherein:

the magnet, the second cavity, and the voice coil are located on a same side of the diaphragm and are fixed in the first cavity;

the second housing is provided with an opening connected to the second cavity; and at least part of the armature is housed in the second cavity through the opening.

15. The speaker according to claim 14, wherein a direction from the diaphragm to the armature is a same direction of a sound generated from the speaker.

16. The speaker according to claim 14, wherein:

the magnet is an annular magnet, and the second cavity is located in a center of the annular magnet.

17. The speaker according to claim 14, further comprising:

a voice coil cavity between the inner wall of the first housing and an outer wall of the second housing, wherein the voice coil is a ring around the second cavity, and at least an end of the voice coil is embedded in the voice coil cavity.

* * * * *